US006360760B1

(12) United States Patent
Louie et al.

(10) Patent No.: US 6,360,760 B1
(45) Date of Patent: Mar. 26, 2002

(54) SELF-ERECTING AND COLLAPSIBLE SHELTER

(75) Inventors: Hang Wai Louie, Hunghom; Ming Tak Yau, Taikoo Shing, both of (HK)

(73) Assignee: Billwin Auto Accessories Limited (HK)

( * ) Notice: Subject to any disclaimer, the term of this patent is extended or adjusted under 35 U.S.C. 154(b) by 0 days.

(21) Appl. No.: 09/454,661

(22) Filed: Dec. 3, 1999

(51) Int. Cl.[7] ..... E04H 15/00

(52) U.S. Cl. ..... 135/123; 135/126; 135/136; 135/137; 135/138; 135/128

(58) Field of Search ..... 135/126, 125, 135/124, 907, 123, 128, 136, 137, 138; 52/222, 63, 86

(56) References Cited

U.S. PATENT DOCUMENTS

| | | | | | |
|---|---|---|---|---|---|
| 3,675,667 | A | * | 7/1972 | Miller | 135/126 |
| 3,990,463 | A | * | 11/1976 | Norman | 135/126 |
| 4,165,757 | A | | 8/1979 | Marks | |
| 4,825,892 | A | * | 5/1989 | Norman | 135/126 |
| 5,137,044 | A | * | 8/1992 | Brady | 135/104 |
| 5,301,705 | A | * | 4/1994 | Zheng | 135/126 |
| 5,411,046 | A | * | 5/1995 | Wan | 135/126 |
| 5,579,799 | A | | 12/1996 | Zheng | 135/126 |
| 5,664,596 | A | * | 9/1997 | Zheng | 135/126 |
| 5,676,168 | A | * | 10/1997 | Price | 135/126 |
| 5,778,915 | A | * | 7/1998 | Zheng | 135/125 X |
| 5,800,067 | A | * | 9/1998 | Easter | 135/126 X |
| 5,816,279 | A | * | 10/1998 | Zheng | 135/126 |
| 5,950,649 | A | * | 9/1999 | Gerig | 135/125 |
| 5,975,101 | A | * | 11/1999 | Zheng | 135/125 |
| 6,109,282 | A | * | 8/2000 | Yoon | 135/126 |

FOREIGN PATENT DOCUMENTS

| | | | | |
|---|---|---|---|---|
| FR | 2635136 | * | 3/1991 | 135/126 |
| JP | 403021779 | * | 1/1991 | 135/126 |
| WO | 91/02870 | * | 3/1991 | 135/126 |

* cited by examiner

*Primary Examiner*—Robert Canfield
(74) *Attorney, Agent, or Firm*—Henri J. A. Charmasson; John D. Buchaca

(57) ABSTRACT

A self-erecting, collapsible fabric shelter structure whose armature comprises two or more panels, each formed by a resiliently flexible filiform loop, and a pair of resiliently bendable arcuate rods tensioned between each two adjacent panels. A piece of cloth is spread between the loop of each end panel to form the end walls, and another over the rods to form the roof of the structure. Each panel can be folded into three small rings by a 360 degree twist of its loop, causing the associated rods to conveniently coil around the rings to form a compact package.

13 Claims, 2 Drawing Sheets

FIG. 6
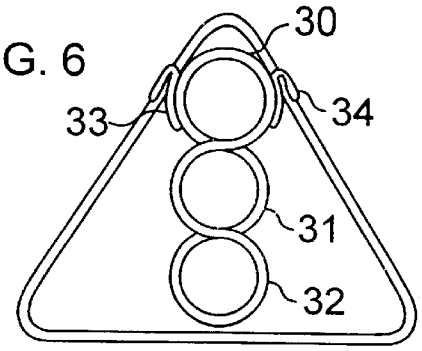
FIG. 7
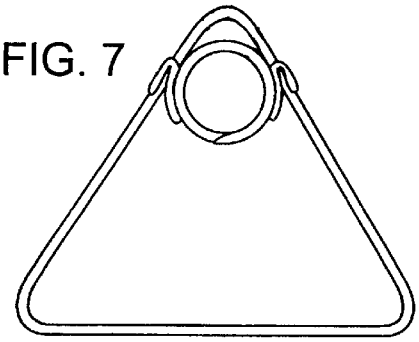
FIG. 8
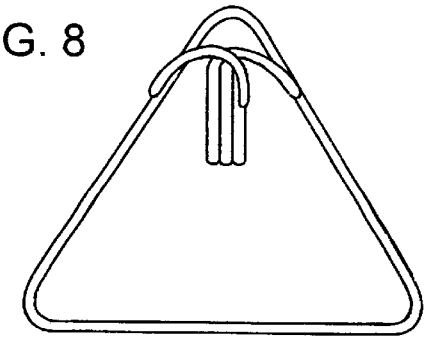
FIG. 9
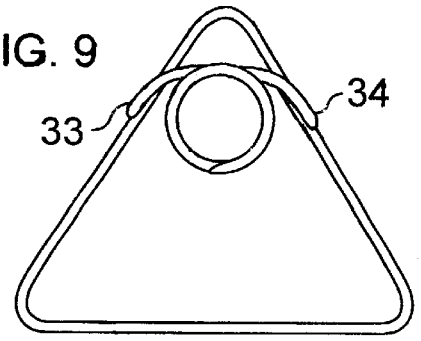
FIG. 10
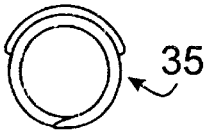
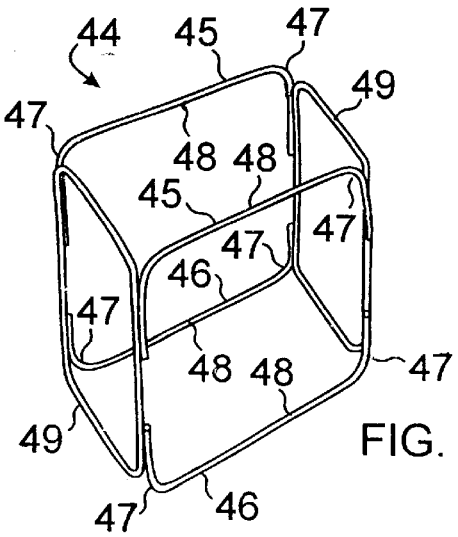
FIG. 12
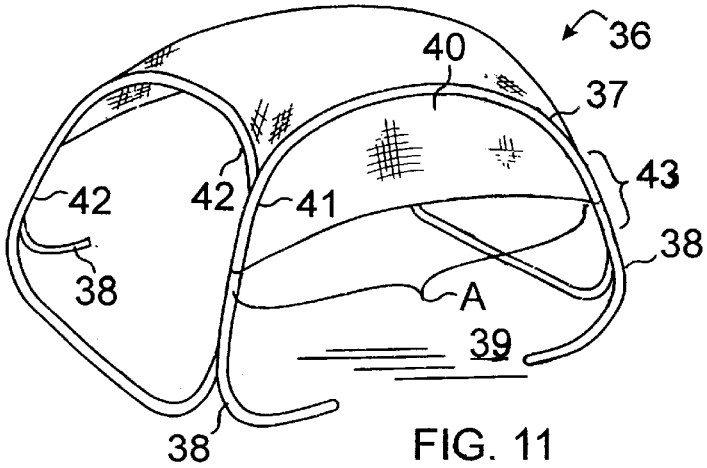
FIG. 11

SELF-ERECTING AND COLLAPSIBLE SHELTER

FIELD OF THE INVENTION

This invention relates to tents and other light, temporary structures made of canvas stretched over a collapsible armature.

BACKGROUND OF THE INVENTION

There is disclosed in the prior art several types of self-erecting tents and similar structures which rely on springy armatures made of wire loops to instantaneously deploy the devices. Some of those simplest structures, such as the ones disclosed in U.S. Pat. No. 4,825,892 Norman, are very unstable and require the use of ground spikes or other securing devices.

More stable, but also more complex self-erecting tents, such as those disclosed in U.S. Pat. No. 5,163,461 Ivanovich et al., use long lengths of steel wire to form numerous loops, adding considerable weight to a device which is intended to be easily carried.

U.S. Pat. No. 5,038,812 discloses another self-erecting tent that requires interconnecting six separate panels to form an enclosed space.

The instant invention results from an attempt to reduce the amount of panels and armature material without compromising the volume and stability of the tent structure, and to improve the structure foldability by reducing the number of wire loop panels.

SUMMARY OF THE INVENTION

The principal and secondary object of this invention are to provide a simple self-erecting and easily collapsible tent structure that combines stability and light weight. These and other valuable objects are achieve in a basic model by using only two wire loops to form the sides of the structure, and two short lengths of flexible rods to connect the sides and form the roof. The rods are bent to bias the sides away from each other, and a floor mat spread between the bases of the side panels are used to position the panel against the tension of the bent rods. In an alternate version of the structure, the rods are bent to form arcs of at least 180 degrees, and webs of fabric spread across the arcs are used to hold the panels at the desired distance from each other. In all cases, the covering can be made of canvas, woven or unwoven cloth or any other fabric-like material.

BRIEF DESCRIPTION OF THE DRAWINGS

FIGS. 6–10 are a diagrammatical views of the various collapsing stages;

FIG. 11 is a perspective view of an alternate embodiment of the invention; and FIG. 12 is a perspective view of an alternate framework.

DESCRIPTION OF THE PREFERRED EMBODIMENT OF THE INVENTION

Figure 1:
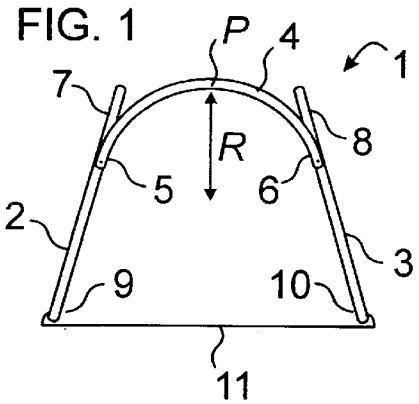
FIG. 1 is a diagrammatical illustration of the supporting structure of the basic shelter.

Referring now to the drawing, there is illustrated in the diagram of FIG. 1 the supporting structure 1 of a basic shelter according to the invention. The structure comprises two side panels 2, 3 preferably made of a resiliently flexible filiform element such as a length of steel cable bent into a closed loop. The panel may have a variety of shapes including triangular, rectangular or trapezoidal. An arcuate and resiliently bendable elongated element such as a length of fiberglass rod 4 has its bent opposite ends 5, 6 secured to the upper lateral sections 7, 8 of the respective side panels. The flexion of the open-ended rod 4 bias the panels away from each other. The lower sections 9, 10 of the side panels which are substantially orthogonal to or at an acute angle to the lateral sections 7, 8 are stabilized by a securing member 11 attached at opposite ends to those lower sections or bases of the side panels. Accordingly, the length of the securing member 11 determines how far apart the side panels are held.

The tensioning rod 4 may be attached over any length to any lateral sections of the side panels, and the securing member 11 can be attached to any part of the panels which is located at least approximately one radius R away from the apex P of the bent rod 4.

Figure 2:
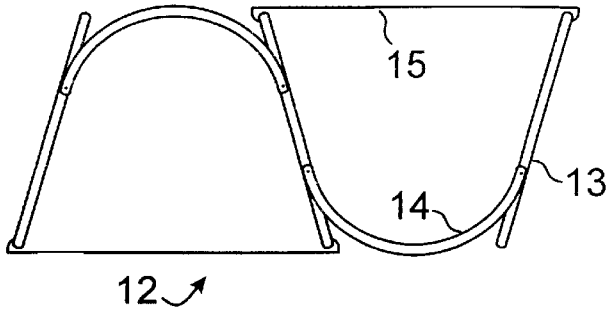
FIG. 2 is a diagrammatical illustration of the supporting structure of an expanded shelter.

In the expanded version 12 of the support structure illustrated in FIG. 2, a third panel 13 is connected to the second one by a second but inverted bent rod 14, and a second securing element 15. The second rod 14 is attached to the lower sections of second and third side panels. The second securing element 15 is attached to their respective upper sections. It should be understood that the support structure can be further expanded by adding alternately inverted sets of panels, tensioning rods, and securing elements.

Figure 3:
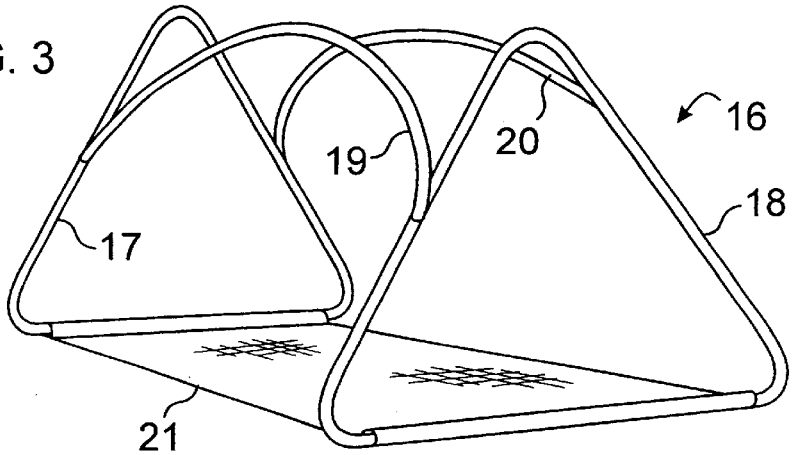
FIG. 3 is a perspective view of the supporting structure of the preferred embodiment of the invention.

In the supporting structure or armature 16 of the preferred embodiment illustrated in FIG. 3, the side panels are constituted by two commensurate wire frames 17, 18 each having the shape of a substantially equilateral triangle. It should be understood that the triangular shape of the panel is imposed by a piece of fabric-like material spread across, and secured to each wire frame. Two resiliently flexible, arcuate fiberglass rods 19, have their opposite ends attached to the upper sections of the lateral sides of the wire frames. The bases of the wire frames are spanned by, and attached to a floor mat 21 which constitutes the securing element that determines their separating distance.

Figure 4:
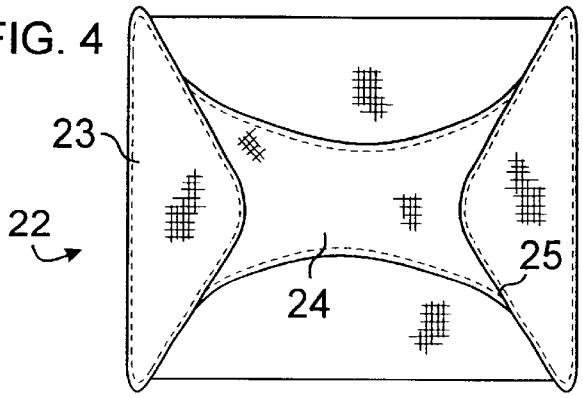
FIG. 4 is a top plan view thereof.

In the complete preferred embodiment 22 of the shelter illustrated in FIG. 4, each side panel is covered by a piece 23 of canvas, or thin and pliable fabric-like material. Another piece 24 of such material is spread between the upper sections of the side panels and over the bent rods. It should be understood that additional cloth panels could be installed over the front and back of the structure with appropriate access openings.

The edges of each piece of material are doubled upon themselves and stitched to form channels through which the frame wires or rod are run.

Figure 5:
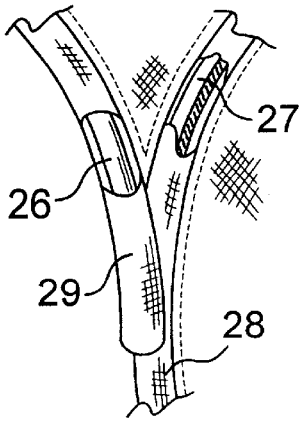
FIG. 5 is a detailed view of the rod attachment.

FIG. 5 illustrates the junction 25 of the end 26 of a rod and the frame wire 27 at the upper section of a side panel where the edge channels 28, 29 of side panel canvas cover and top canvas cover meet and are stitched together.

The entire structure can be conveniently collapsed into a compact and lightweight package by following the steps partially illustrated in FIGS. 6–10.

First one of the side panels is twisted 360 degrees about the vertical axis into three rings 30, 31, 32 as shown in FIG. 6. It should be noticed that the flexible rods 33, 34 are also bent to wrap around the top ring 30. Next, the second and third rings are folded over the first as shown in FIG. 7. The stacked rings are then rotated 180 degrees about the vertical axis as illustrated in FIGS. 8 and 9. The same steps are followed to fold the second panel, and to yield the final compact configuration 35 illustrated in FIG. 10. When free of any constraint, the entire structure will self deploy into the fully erected original shelter.

It should be noted that the basic structure comprises only two wire-loops making its folding a great deal easier than the more complex prior art structures.

In an alternate embodiment of the invention illustrated in FIG. 11, the arcuate tensioning rods 37 have opposite end-portions 38 extending down to the ground support surface 39. A web 40 of fabric is spread over an arc A of at least approximately 180 degrees defined by the upper and central part 41 of each bent rod 37, and secured along its rounded edge to the rod 37 and to parts of the side panel frames 42. The rod end portions 38 can also be secured to the side panel frames 42 over the length 43 of their parallel and adjacent courses. The webs 40 act as securing means to position and hold the side panels at a desired and given distance from each other. The tensioning floor mat of the previous embodiment is not necessary. It should be understood that the webs 40 can extend over the entire planes defined by the tensioning rods 37, and that one or both of the side panels can be devoid of fabric cover.

In an alternate embodiment supporting framework 44 illustrated in FIG. 12, two end-to-end tensioning rods 45, 46 are used to form the front and back panels or walls. The rods, although generally arcuate, have sharper angles 47, are rather straight central segments 48 in order to yield a near square or cubic structure. By securely tying the two rods 45, 46 to side loop frame 49, there is no need for a securing web across the front or back panel. In other words, each rod acts as a limiting element to the spreading tension imparted to the side loop frames 49 by the other rod.

While the preferred embodiments of the invention have been described, modifications can be made and other embodiments may be devised without departing from the spirit of the invention and the scope of the appended claims.

What is claimed is:

1. A self-erecting, collapsible shelter which comprises:

first and second panels, each of said panels having a first lateral section and, a lower section substantially orthogonal to or at an acute angle to said first lateral section;

first elongated tensioning member having spaced-apart, open-ended portions wherein each of said portions are secured to a first lateral section of one of said panels, said tensioning member being positioned for biasing away from each other said lower sections; and securing means for holding apart at a given distance, said lower sections against said biasing.

2. The shelter of claim 1, wherein each of said panels comprises an armature including a resiliently flexible filiform member coiled into a closed loop.

3. The shelter of claim 2, wherein each of said panels further comprises a piece of fabric-like material spread across and secured to said armature.

4. The shelter of claim 1, wherein said tensioning member comprise at least one arcuate and resiliently flexible rod.

5. The shelter of claim 4, wherein:

each of said panels has two opposite edges; and said tensioning member comprises two of said rods, each rod being secured to a part of one of said edges.

6. The shelter of claim 2, wherein:

each of said panels has a base edge; and said securing means comprise a length of fabric-like material spanning said base edges.

7. The shelter of claim 4, wherein said arcuate rod is bent to form an arc of at least approximately 180 degrees; and said securing means comprises a web of fabric-like material spread across said arc and secured to said flexible rod.

8. The shelter of claim 5 which further comprises a length of fabric-like material spread over said rods between said panels.

9. The shelter of claim 2 which further comprises:

a third panel substantially similar to said first and second panels;

a second tensioning member secured to lower portions of the lateral sections of said second and third panels, said second tensioning member being positioned for biasing away from each other the first lateral sections of said second and third panels; and second securing means for holding apart upper portions of the first sections of said second and third panels.

10. The shelter of claim 9, wherein each of said first and third panels further comprises a piece of fabric-like material spread across and secured to the armature thereof.

11. The shelter of claim 10, wherein said second tensioning member comprise at least one arcuate and resiliently flexible rod.

12. The shelter of claim 11, wherein:

each of said panels has two opposite edges; and said second tensioning member comprise two of said rods, each rod being secured to lower parts of said edges of each one of said second and third panels.

13. The shelter of claim 12, wherein:

each of said second and third panels has an upper section; and said second securing means comprise a length of fabric-like material spanning the upper sections of said second and third panels.

* * * * *